United States Patent [19]

Kinshofer

[11] Patent Number: 5,014,870

[45] Date of Patent: May 14, 1991

[54] CONTAINER WITH A HANDLING DEVICE

[75] Inventor: Alfred Kinshofer, Miesbach, Fed. Rep. of Germany

[73] Assignee: Kinshofer Greiftechnik GmbH, Miesbach, Fed. Rep. of Germany

[21] Appl. No.: 522,547

[22] Filed: May 11, 1990

[30] Foreign Application Priority Data

May 12, 1989 [DE] Fed. Rep. of Germany ..... 3915580

[51] Int. Cl.[5] ..... B65D 43/00

[52] U.S. Cl. ..... 220/263; 220/211; 220/318

[58] Field of Search ..... 220/318, 908, 211, 250, 220/260, 262, 263

[56] References Cited

U.S. PATENT DOCUMENTS 1,755,426 4/1930 Christensen ..... 220/211
1,976,917 10/1934 Boscardin ..... 220/263 X
2,408,132 9/1946 Weeks ..... 220/263 X
4,489,810 12/1984 Curtis ..... 220/263

*Primary Examiner*—Steven M. Pollard
*Attorney, Agent, or Firm*—Morgan & Finnegan

[57] ABSTRACT

A container is disclosed which makes the coupling a coupling device of lifting gear, such as a crane, with the container without requiring additional alignment operations as performed by special instrumentalities or by manual labor. The coupling device includes a first coupling member which consists of a bushing having an upper flange-like border, which is arranged centrally on the top side of the container. This bushing serves simultaneously as a guide member for a second coupling member which is in the form of a pull bar. The second coupling member, as well, is provided with an upper flange-like border. When handling the container one may use the coupling device with at least two hooks, which are fitted, respectively, under the flange-like borders of the coupling members in a circumferential distribution.

15 Claims, 5 Drawing Sheets

CONTAINER WITH A HANDLING DEVICE

The invention relates to containers. More particularly, this invention relates to a container of the type having a closing mechanism which is provided for discharge doors on the container and which comprises a first coupling member fixedly secured to a wall of the container and a second coupling member in the form of a pull bar which is adapted to run longitudinally in a guide bushing connected with the wall of the container. The second coupling is connected by flexible traction elements with the discharge doors of the container in such a manner that, when the pull bar is in a retracted state, the traction elements are relieved and the doors are open, and, when the pull bar is in an extended state, they are loaded and the discharge doors are shut.

BACKGROUND OF THE INVENTION

Containers of this type generally described above are disclosed in European Patent Publication EP 0 280 008 A 1 and in which the coupling members of the container are constituted by eyes for connecting the container with the load and traction hooks of a lifting gear or device. However, in coupling and uncoupling the lifting gear, a difficulty is encountered since the load and traction hooks have to be twisted and shifted before they are able to be hooked into the eyes. Consequently, as a rule, manual operations must be performed by operators using the container and lifting gear, or the assistance of a specially designed means is required in order to grip both of the hooks.

There exists, therefore, a need to provide a container of the type described in the above-mentioned European Patent Publication which does not exhibit this disadvantageous difficulty. The present invention fulfills this need.

BRIEF STATEMENT OF THE INVENTION

A primary object of the present invention is, therefore, to provide a container of the type described to which a handling device may be readily coupled without external assistance.

In order to achieve this object, as well as other objects which will be apparent from the following description of the invention, there is provided a container which comprises a closing mechanism connected to discharge doors on the container, the closing mechanism having a first coupling member comprising a bushing having a flange-like border and which is arranged centrally on the top side of the container and which at the same time constitutes the guide bushing for a second coupling member in the form of a pull bar, the second coupling member having an upper flange-like border.

One advantage of such a container resides in the fact that a suitable handling device for lifting and lowering the container and for opening closing the discharge doors thereof can be centrally connected to the container without the need to provide a means for gripping and guiding the two hooks of the lifting device or gear in a predetermined manner.

In accordance with further features of the invention, the bushing may have a square inner bore and the pull bar may have a complementary cross sectional outline. Moreover, the flange-like borders may be annular.

Each of the flange-like borders may also have an annular groove on their lower sides, each such groove having an obliquely outwardly descending flank.

In accordance with another possible feature of the invention, the container is a body of revolution and the first coupling member is so arranged on the container that the line of symmetry of the bushing forming the first coupling member coincides with the line of symmetry of the container.

In connection with these further features, it is particularly advantageous that the flange-like borders be in fact annular and be provided with an annular groove with a flank sloping downwards and obliquely outwards, since with such an arrangement, the hooks of the coupling means of lifting gear or device do not have to be aligned and can engage any part of the periphery of the respective flange-like borders. The engaging hooks are drawn down by the weight of the upwardly moved container and inwardly into the circumferential grooves so that they are not able to come unlocked.

In accordance with a further possible feature of the invention, a coupling device of a lifting gear may be used for handling the container in accordance with the invention. This coupling device has, respectively, at least two hooks, which fit under the flange-like borders of the coupling members in a circumferential distribution. These hooks are arranged in a housing provided with a top lifting eye, so that they may turn about a respective axis running through the hooks, the arrangement being such that the hooks for fitting under the flange-like border of the first coupling member are arranged stationarily in the housing, whereas the hooks for fitting under the flange-like border of the second coupling member are connected with a vertically movable draw-out device, located in the housing, for tensioning and relieving the traction elements.

Such a coupling member may be designed in a particularly compact and space-saving form, if the pairs of hooks, which fit under the two flanges of the coupling members, are arranged so as to be offset in relation to each other in the direction of turning.

In accordance with an additional advantageous feature of the invention, the draw-out element or device of the coupling device may be constituted by a piston and cylinder unit, whose cylinder is secured to a yoke bearing the pivoting hooks and whose piston rod has its upper end connected with the top end part of the housing, the piston and cylinder unit being encircled or surrounded by a compression spring urging the piston in the draw-out direction. Such a construction of the draw-out device is advantageous since only one hydraulic line is required.

The hooks of the coupling device are pivoted in a similar manner. For this purpose, the hooks are urged in the closing direction by compression springs, which fit around guide bars, and, for pivoting the hooks in the opening direction, hydraulic piston and cylinder units are provided. This arrangement, as well, entails the provision of only one hydraulic line for a respective piston and cylinder unit.

Another advantageous feature of the invention resides in a design in which the piston and cylinder units for releasing the upper pair of hooks are provided with freely extendible pistons. With such construction, it is possible for the upper hooks to be pivoted outwardly against the spring force. In order to ensure in such a modification that this does not cause the draw-out device to be pressed upwardly, at least one pivot pin located on a lower hook is provided. This pivot pin has an upwardly extending locking lever pivoted thereon and on which the piston, acting on the respective hook, of the hydraulic piston and cylinder unit, is provided. In this modification, the piston is connected with the associated hook via a slot pin guide means so that during release of the hook the one lever fits over at least one projection, forming an abutment of the yoke, before the hooks are swung outwards to the full extent. Thus, the upper coupling member is kept in place by the lever, when the lower and upper hook pairs are pivoted out of the position engaging the first and second coupling members of the container. The provision of the slot guide causes a time delay during the outward pivoting of the lower pair of hooks, thus making possible trouble-free outward pivoting of the lower and upper hooks from the engaged positions with the first and second coupling members. In the outwardly pivoted position of the hooks, the lever will remain in engagement with the projection, forming the abutment of the yoke, on the lower end of the draw-out device. This, however, also ensures that on setting down the coupling device on the coupling mechanism of the container there is no chance of the draw-out element or device being shifted out of position against the action of the compression spring by the jerk caused by such setting down. Thus, on setting down in position, the lower and upper hooks may be directly swung into their correct engagement position in relation to the coupling members.

In accordance with a further particularly advantageous feature of the coupling device, the housing is made in two parts, a lower part being adapted to be turned by a rotary motor and an upper part. The two parts of the housing are separated from each other by a rotary lead-through. In this respect, the piston of the draw-out element or device is carried in a cage, which rotates with the lower part of the housing and extends into the upper part of the housing. The cage is suspended so that it can swing like a pendulum in order to make possible a corresponding swinging motion of the hydraulic piston and cylinder of the draw-out element or device during the coupling operation.

The invention, still further, provides a coupling member for use with containers, such as those described above, and which, in addition to a shank part have a head part with flange-like projecting borders and, in accordance with a preferred form of this invention have a convexly formed top surface like the cap of a dome or the cap of a mushroom. This convex configuration of the head part makes it possible for the coupling member which is being inserted, to be engaged in a positive or substantially positive manner, so that there is a centering of the coupling element within the gripper and thus, damping or even completely preventing any possible, otherwise likely, rocking motion of a container when lifted from the ground. In accordance with a further feature of the invention, the head part has an annularly encircling groove on its lower side into which the corresponding hook elements or the like of the gripper may securely fit.

Further details, features and advantages of the invention will now be described with reference to the working embodiment shown in the accompanying Drawings.

THE DRAWINGS

DETAILED DESCRIPTION OF WORKING EMBODIMENTS OF THE INVENTION

Figure 1:
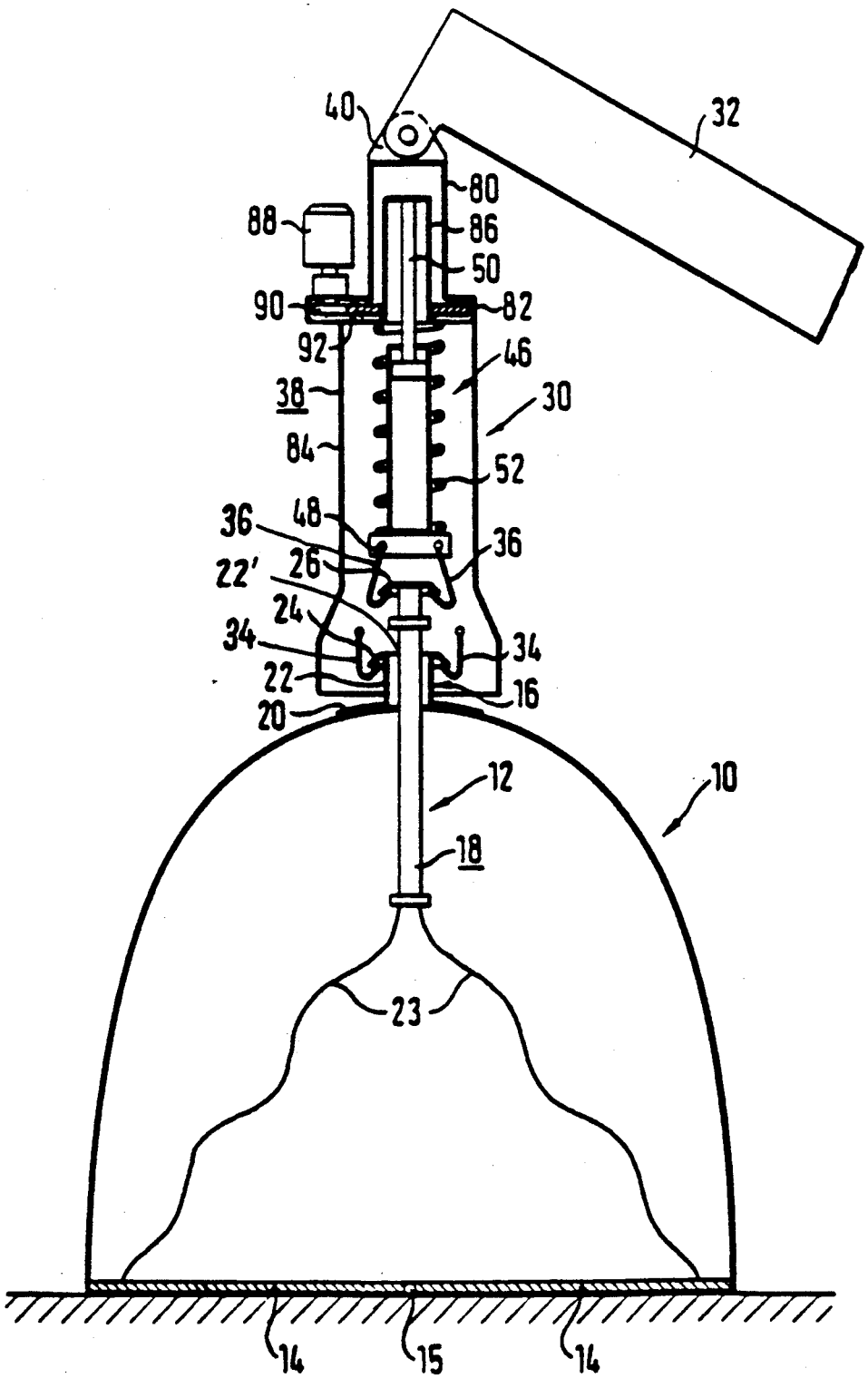
FIG. 1 is a diagrammatic overall view of a container in accordance with the invention shown together with a coupling device on a lifting gear.

Referring now to FIG. 1, a container 10, according to the invention, shown resting on the ground, may have the form of a body of revolution, or a round or circular body. Container 10 has associated therewith a closing mechanism 12 connected to discharge doors 14, which form part of the container. In the illustrated working embodiment of the invention, the discharge doors 14 are in the form of bottom doors, which are adapted to pivot downwardly about a central hinge 15. It is to be understood, however, that, in accordance with the invention, the container may have another configuration, being, for example, rectangular or square, and being provided with moving side doors.

At the top of container 10, which in FIG. 1 is in the form of a body of revolution and which is adapted to be frequently charged and discharged, there is a first coupling member 16, comprising a bushing 22, which is screwed, welded or joined in some other convenient manner, by interlocking or bonding on the container by a base portion 20 fixed to the container and which is provided with an upper flange-like border 24. Bushing 22 is centrally aligned o container 10 and serves simultaneously as a guide bushing for a second coupling member 18 in the form of a pull bar and which is part of closing mechanism 12. The pull bar also has an upper flange-like border 26. In a neutral setting, the upper, flange-like border 26 of the pull bar will be at a higher level than the upper flange-like border 24 of the first coupling member 16. The pull bar of the second coupling member 18 extends into the interior of the container 10. At the lower end of the pull bar, there are adjoining traction elements 23, which are connected with a freely pivoting ends of the discharge doors 14. In the retracted or drawn-in position of the pull bar of the second coupling member 18, the traction elements 23 are in a relieved state, as is indicated in FIG. 1.

Bushing 22 has a square hole 22' and the pull bar of the second coupling member 18 has a complementary cross sectional outline. This serves to ensure that the pull bar is not able to rotate about its own axis and that free motion of the traction elements 23 is not impended by twisting or jamming of the elements so as to interfere with each other. However, as a matter of basic principle, it would be possible for the bushing 22 to have other forms of bore shapes, that is round, triangular, hexagonal, octagonal and the like.

As further shows in FIG. 1, the container of this invention also has associated therewith coupling device 30 of lifting gear or device 32 for handling the container 10. Coupling device 30 is pin-connected to the lifting gear by means of a connection eye 40. The central elements of the coupling device are a lower and an upper pair of hooks 34 and 36, respectively. The lower pair of hooks 34 serves to come into engagement with the first coupling member 16. The upper pair of hooks 36 served to come into engagement with the second coupling member 18. The flange-like borders 24 and 26 of the coupling members 16 and 18 are designed with an annular configuration and on their lower sides are provided with a respective annular groove 28 and 29, respectively, each of the grooves being provided with a flank which with slopes obliquely outwardly and downwardly. The hooks 34 and 36 are additionally secured by engagement in the annular grooves 28 and 29, since they are drawn into the annular groove under the load of the container.

The lower hooks 24 of the coupling device constitute the load hooks. Thus, it is by way of these hooks that the entire container is lifted upwardly using the coupling member 16 firmly linked to the container 10. However, before this takes place, it is necessary for the discharge doors 14 to be locked in the shut position by means of the traction elements 23, so that when the container 10 is lifted from the ground, the doors 14 are not opened. For this purpose, the second coupling member 18 is drawn upwardly by means of the hooks 36 until the traction elements 23 are loaded so that swinging open of the discharge doors 14 on lifting the container 10 clear of the ground is precluded. During this operation, the inner square pull bar of the second coupling member is drawn out for a distance of around about 50 cm. In this position of the coupling device 30, the container is lifted, for instance by the jib 32 of a crane (not illustrated) and slewed over a load receiving surface such as the load carrying body of a truck. By lowering the pull bar, and thus the traction elements 23, the discharge doors 14 are opened, so that the entire container contents, as for example, refuse, may drop out of the container.

In a similar manner, the container may be closed and set back down on the ground.

Hooks 36, which serve to move the pull bar of the second coupling member 18 upwardly and downwardly, are moved by means of a vertically moving draw-out device 46 arranged in the housing 38, as shown in FIG. 1. This draw-out device 46 comprises a hydraulic piston and cylinder unit 49, whose cylinder is connected to a yoke 48 bearing the pivoting hooks 36 and whose piston rod 50 has its upper end connected with the upper end of the housing 38. The piston and cylinder unit 49 is contained within a compression spring 52, which so urges the yoke 48 that the cylinder with the hooks 36 is pushed downwardly. Simultaneously, hydraulic fluid is displaced from the cylinder through a hole (not shown) in the piston rod 50. In order to move the cylinder, and thus also move the hooks 36 upwardly, hydraulic fluid is pumped back into the cylinder via a hydraulic line (not shown), so that within the piston and cylinder unit 49, the piston is displaced against the action of the compression spring 52 along the cylinder. Accordingly, for operation of the draw-out device 46, only one hydraulic line (not illustrated) is required.

Figure 2:
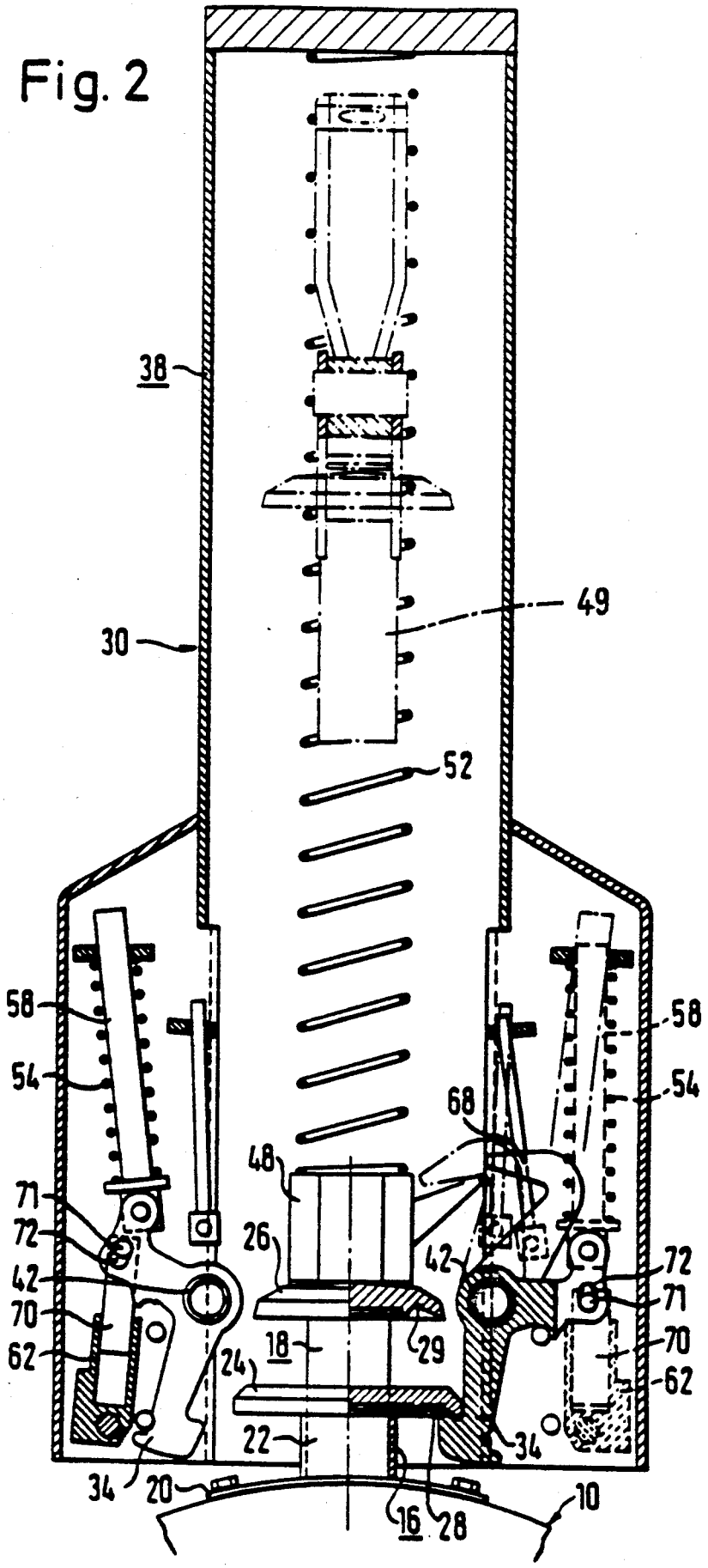
FIG. 2 is a diagrammatic, detailed, partial, longitudinal, sectional view of the coupling device illustrated in FIG. 1.
Figure 4:
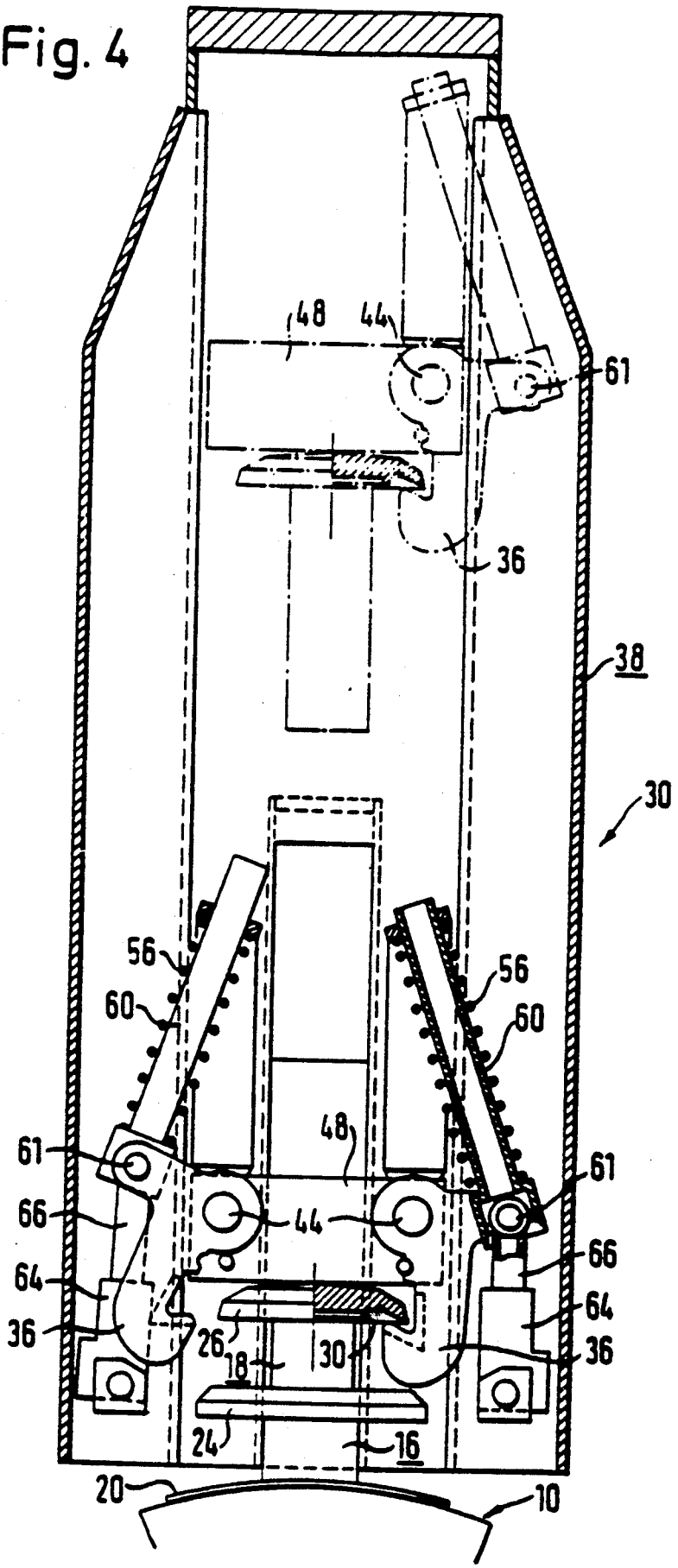
FIG. 4 is a diagrammatic, detailed, partial, longitudinal, sectional of the coupling device of FIG. 2, but with the plane of the section turned through 90°.

The lower hooks 34 are arranged in the housing 38 of the coupling device 30 in a stationary manner so as to be offset by 90° in the direction of rotation in relation to the upper hooks 36, as shown more particularly in FIG. 2. Hooks 34 are mounted so as to be able to pivot on a shaft 42, as illustrated in FIG. 2. Lower hooks 34 are pivoted in the opening direction out of their closed setting, that is to say, out of their engagement with the first coupling device 16, by hydraulic piston and cylinder units 62. When this takes place, they are moved against the force of the compression springs 54 mounted on guide rods 58 (FIG. 2). For pivoting the hooks 34 back again for placing or fitting them under the flange-like border 24 of the first coupling member 16, compression springs 54 are provided which urge the hooks 34 in the closing direction. Simultaneously, hydraulic fluid is displaced into the piston and cylinder units 62. Guide rods 60 (FIG. 4) are also pivotally connected with the upper hooks 36 as well, and these rods are surrounded by compression springs 56. The latter also urge the hooks 36 into the closed setting, that is to say, they swing the hooks 36 about the shafts 44 arranged on the yoke 48 of the draw-out device 46 so that the hooks fit under the flange-like border 26 of the second coupling member 18. In order to pivot the hooks 36 outwardly, they are acted upon at the articulation point of the guide rod 60 with the freely extendible piston 66 by the piston and cylinder units 64. In this case as well, the piston and cylinder units, respectively, only require a single direction hydraulic line (not shown) since a resetting, that is to say, inward pivoting of the upper hooks 36 into the engagement position with the upper flange-like part 26 of the second coupling member 19, takes place under the action of the compression spring 56.

All the piston and cylinder units 62 and 64, respectively, acting on the hooks 34 and 36 are supplied via a single hydraulic feed line so that the pistons of the piston and cylinder units 62 and, respectively, 64 are able to be extended only simultaneously.

Figure 3:
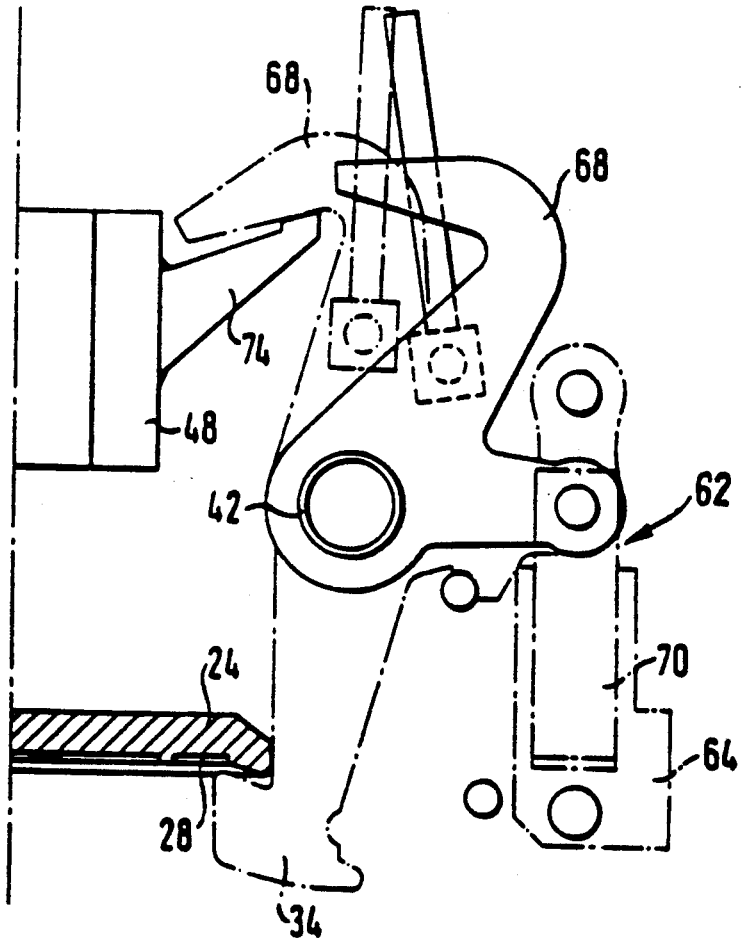
FIG. 3 is a diagrammatic view in detail of a hook mechanism of the coupling device, illustrated in FIGS. 1 and 2.

When a piston 66 moves outwardly towards the articulation point 61 there is, however, a certain danger of the motion of the piston not only being converted into a pivoting motion and moving the hook 36 about the shaft 44 but also causing a longitudinal sliding motion on the yoke 48 and moving of the yoke against the force of the compression spring 52 with the hook 36 then remaining hooked in the groove 30 and being prevented from swinging out. This is prevented, however, since during the outward pivoting of the hooks 36, the yoke 48 is held stationary in relation to the container 10. This is ensured by the provision of two locking levers 68 (FIG. 3). The latter are pivoted on the shafts 42 of the lower hooks 34. In the engagement position of the lower hooks 34 and thus of the upper hooks 36, as well, the locking levers 68 are pivoted into an open position so that the yoke 48 together with the hooks 36 is able to be pushed upwardly using the draw-out device 46. A locking lever is shown in this position in FIG. 3 in full lines. When the hooks 34 and 36 are swung outwardly, levers 68 have to fit over projections 74 which form abutments of the yoke 48. The locking levers 68 are pivoted by means of piston rods 70 of the piston and cylinder units 62 with which they articulate. In order to time the pivoting of the locking levers 68 in their closing position so as not to be simultaneous with the pivoting of the levers 34 into their opened setting, the lower hooks 34 are connected with the pistons 70 of the piston and cylinder units 62 via slots 72 in the lower hooks into which pins 71, disposed on the cylinders, extend.

Consequently, the locking mechanism operates as follows: During outward motion of the piston 70, locking lever 68 is pushed out of its outwardly swung release position into the locking position. The lower hooks 34 are then able, owing to the provision of the slot 72, to remain in their initial position during the first part of the stroke of the piston 70. It is only later, when the pin on the piston rod reaches the end of the slot 72, that the corresponding lower hook 34 is pivoted out of its engaging position. Due to the cooperation, as described above, of the hooks 34 and 36 and of the lock levers 68, proper unlocking of the coupling device takes place.

Figure 5:
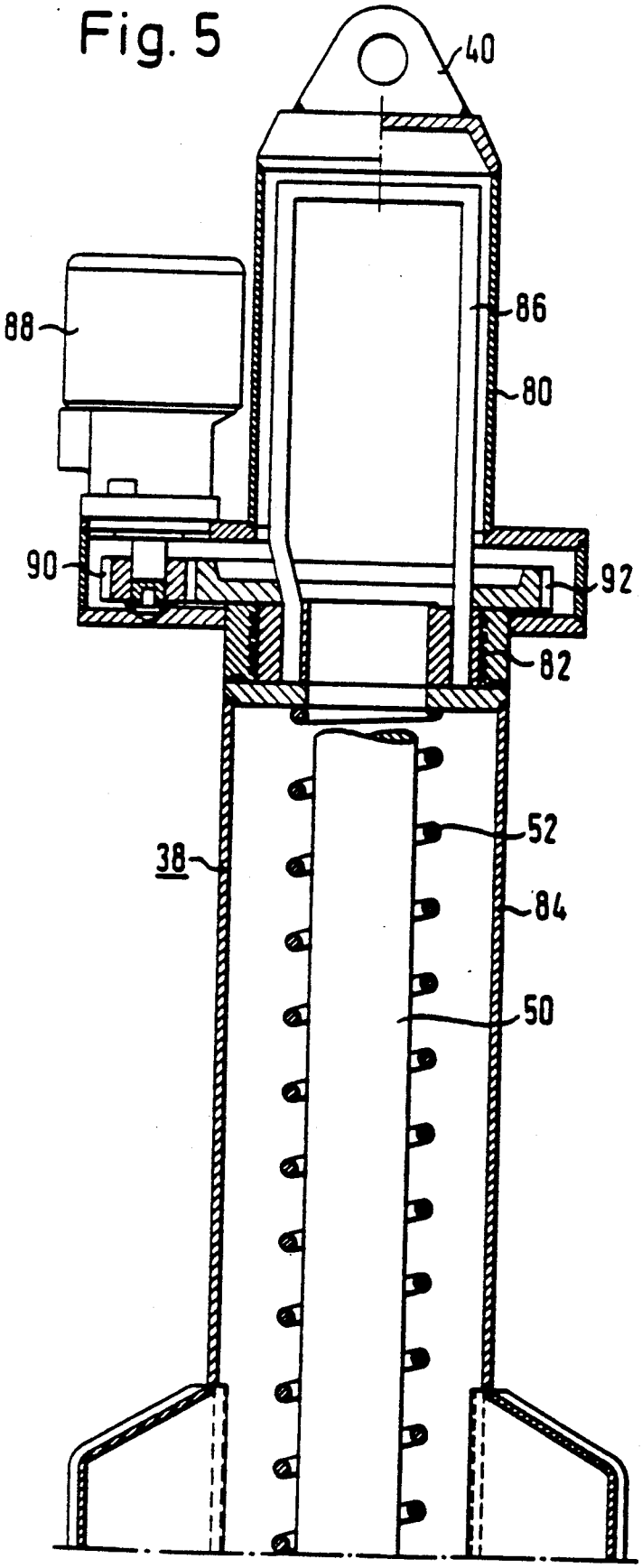
FIG. 5 is a diagrammatic partial, longitudinal, sectional view of the coupling device shown in FIG. 1 and taken through the upper part of the coupling device.

In FIG. 5, the upper part of a particular form of the coupling device, as described above, is shown. A coupling device in accordance with this embodiment of the invention makes possible a twisting of the lower part 84 of the housing 38 together with the pairs of hooks 34 and 36 arranged in the lower part and a coupled refuse container 10. This is more particularly necessary if the container is not a body of revolution. The upper part 80 of the housing 38 is connected with the lower housing part 84 via a rotary lead-through 82. The turning of the lower housing 84 is performed using a hydraulically driven rotary motor 88. A pinion 90 flanged on the motor 88 meshes with a gearwheel 92, which is connected with the lower part 84 of the housing 38. In the case of this embodiment of the invention, the piston 50 of the draw-out element on device 46 is mounted in a cage 86. Cage 86 is arranged in a swinging manner pendulumwise in the lower part 84 of the housing so that it rotates with the latter. However, it also extends into the upper housing part 80.

The rotary hydraulic motor may be of the reversible type and, accordingly, be connected with two hydraulic lines.

All of the coupling mechanisms described hereinabove, that is to say, the first and second coupling members 16 and 18, respectively, of the container 10 and of the pairs of hooks 34 and 36, respectively, and the locking levers 68 are arranged in radial symmetry about a common center axis of the container mechanism.

What is claimed is:

1. A container comprising a closing mechanism connected to discharge doors on said container, said closing mechanism having a first coupling member fixedly secured to a wall of said container and a second coupling member in the form of a pull bar which is adapted to run longitudinally in a guide bushing located on the wall of said container and which second coupling member is connected by flexible traction elements to said discharge doors, said flexible traction elements being relieved when said pull bar is in a retracted state and loaded when said pull bar is in an extended state and said discharge doors are shut, said first coupling member comprising a bushing handling a flange-like border, said bushing being centrally located on the top side of said container and constituting the guide bushing for said second coupling member, and said second coupling member having an upper flange-like border.

2. A container according to claim 1 wherein the guide bushing has a square bore and the pull bar has a cross sectional outline complementary to said square bore.

3. A container according to claim 1 wherein the flange-like borders are of annular shape.

4. A container according to claim 1 wherein each of the flange-like borders has an annular groove on the lower side, each said groove having a groove flank which slopes obliquely downwards towards the outside of the flange-like borders.

5. A container according to claim 1 wherein the container is a body of revolution and the first coupling member is located on the container, and the line of symmetry of the bushing forming said first coupling member coincides with the line of symmetry of the container.

6. A coupling device comprising lifting gear adapted for handling a container according to claim 1, said coupling device comprising at least two hooks for fitting under the flange-like borders of the coupling members in a circumferential distribution.

7. A coupling device according to claim 6 wherein the hooks are located in a housing having an upper lifting eye which pivots about a respective shaft extending through each hook, the hooks fitting under the flange-like border of the first coupling member being connected stationarily in said housing and the hooks for fitting under the flange-like border of the second coupling member being connected with a vertically movable draw-out device located in said housing which tensions and relieves the traction elements.

8. A coupling device according to claim 7 wherein the housing has an upper part, which is connected by a rotary lead-through to a lower housing part, the upper part of the piston rod being retained in a cage which extends into the upper part of said housing and is adapted to rotate with the lower part of said housing, and a rotary hydraulic motor is connected with the upper part of said housing, said motor having a pinion in mesh with a gearwheel connected to the lower part of said housing.

9. A coupling device according to claim 6 wherein a pair of hooks fits under the flanges of each of the coupling members, and the hooks of each pair are placed opposite to each other, the pair of hooks engaging the first coupling member being offset in the direction of rotation in relation to the pair of hooks engaging the second coupling member.

10. A coupling device according to claim 9 wherein the draw-out device comprises a hydraulic piston and cylinder unit, the cylinder being connected to a yoke bearing the pivoting hooks and the piston rod having an upper end connected to an upper end part of the housing, said piston and cylinder unit being surrounded by a compression spring urging said piston into an extended position.

11. A coupling device according to claim 10 wherein the pairs of hooks are urged in the closing directing by compression springs which surround guide rods and hydraulic piston and cylinder units are provided for pivoting the hooks in the opening direction.

12. A coupling device according to claim 4 wherein the piston and cylinder units have freely extendible pistons for release of the upper pair of hooks.

13. A coupling device according to claim 10 wherein an upwardly extending locking lever pivots on at least one pivot shaft of a lower hook and the piston of the hydraulic piston and cylinder unit acts on the associated hook, said hydraulic pint and cylinder unit articulates with said locking lever, the piston of said hydraulic piston and cylinder unit being connected with said associated hook via slot and pin guide and at least one locking lever engages a projection on the yoke which forms an abutment on opening of the hooks and before said hooks are completely deflected in a pivoting manner.

14. A coupling device for a container according to claim 1 wherein the coupling device has a shank part and an upper flange-like border, the upwardly directed surface of said border being generally in the form of a mushroom cap.

15. A coupling device according to claim 14 wherein the lower face of the flange-like border is provided with a circular symmetrical groove.

* * * * *